US007600820B2

(12) United States Patent
Bouche et al.

(10) Patent No.: US 7,600,820 B2
(45) Date of Patent: Oct. 13, 2009

(54) CHAIR SHELL WITH INTEGRAL HOLLOW CONTOURED SUPPORT

(75) Inventors: Timothy J. Bouche, Green Bay, WI (US); Timothy G. Hornberger, Green Bay, WI (US)

(73) Assignee: Krueger International, Inc., Green Bay, WI (US)

( * ) Notice: Subject to any disclaimer, the term of this patent is extended or adjusted under 35 U.S.C. 154(b) by 0 days.

(21) Appl. No.: 12/026,151

(22) Filed: Feb. 5, 2008

(65) Prior Publication Data

US 2009/0195047 A1 Aug. 6, 2009

(51) Int. Cl.
*A47C 7/02* (2006.01)

(52) U.S. Cl. ..... 297/452.14; 297/452.65

(58) Field of Classification Search ..... 297/452.12, 297/452.11, 452.14, 452.19, 239, 452.65
See application file for complete search history.

(56) References Cited

U.S. PATENT DOCUMENTS 3,131,970 A * 5/1964 Mcgregor ..... 297/451.8
3,147,997 A * 9/1964 Mason ..... 297/452.14
3,451,672 A * 6/1969 Aralee ..... 472/4
3,669,496 A 6/1972 Chisholm
3,751,109 A 8/1973 Dufton
3,841,704 A * 10/1974 Platner et al. ..... 297/452.55
4,088,367 A * 5/1978 Atkinson et al. ..... 297/452.14
4,123,105 A * 10/1978 Frey et al. ..... 297/451.1
4,502,731 A 3/1985 Snider
4,555,140 A * 11/1985 Nemoto ..... 297/452.54
4,577,907 A * 3/1986 Talmon et al. ..... 297/452.12
4,805,962 A * 2/1989 Sacco et al. ..... 297/452.14
5,342,110 A 8/1994 Merrick
5,522,645 A * 6/1996 Dahlbacka ..... 297/452.55
5,594,983 A 1/1997 Karl et al.
5,810,438 A * 9/1998 Newhouse ..... 297/286
5,857,742 A 1/1999 Karl et al.
6,027,171 A * 2/2000 Partington et al. ..... 297/452.18
6,089,669 A * 7/2000 Wilcox et al. ..... 297/452.65
6,783,184 B2 8/2004 DiBattista et al.
2004/0212241 A1 10/2004 Wu
2004/0212244 A1 10/2004 Wu
2004/0262977 A1 12/2004 DiBattista et al.
2005/0012369 A1* 1/2005 Mendenhall et al. ..... 297/239
2005/0168041 A1 8/2005 Glance et al.
2005/0264083 A1 12/2005 Ambasz

* cited by examiner

*Primary Examiner*—David Dunn
*Assistant Examiner*—James Alex
(74) *Attorney, Agent, or Firm*—Andrus, Sceales, Starke & Sawall, LLP

(57) ABSTRACT

A molded chair shell includes a seat portion and a back portion joined at a junction area. A support or reinforcement member is located at the junction area and is formed integrally with the seat portion and the back portion. The reinforcement member includes an internal cavity between the seat portion and the back portion that is substantially positioned over the junction area. The cavity is formed by cavity walls, which may form ribs that extend forwardly along the seat portion and upwardly the back portion of the chair shell. The chair shell may be formed in an injection molding process, and the internal cavity may be formed in a gas assist operation carried out during the injection molding process.

19 Claims, 3 Drawing Sheets

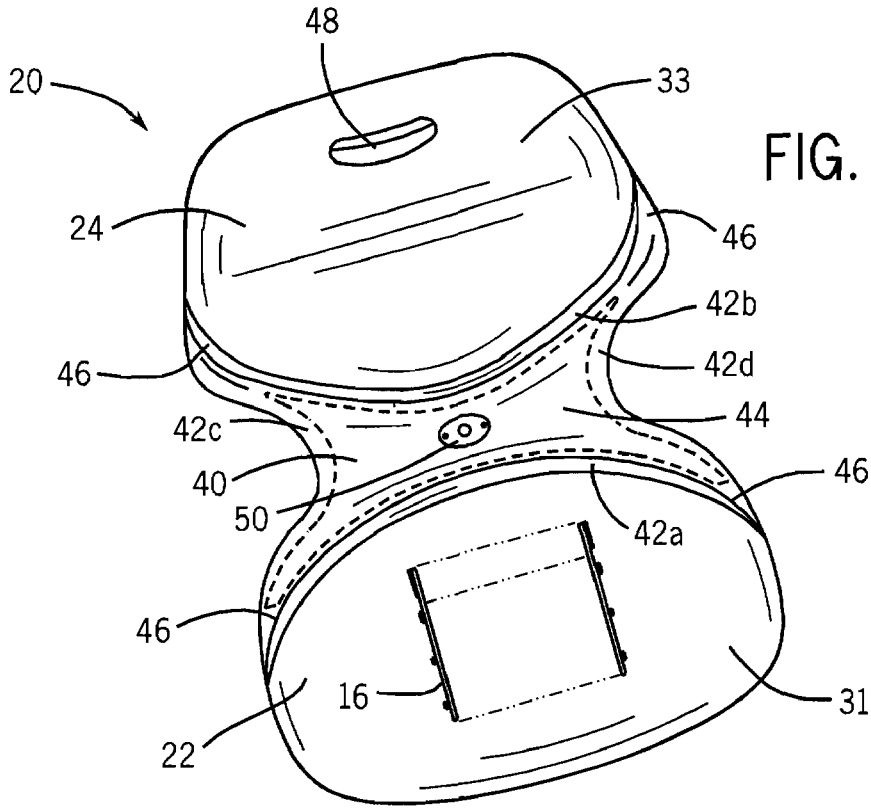
FIG. 3
FIG. 4
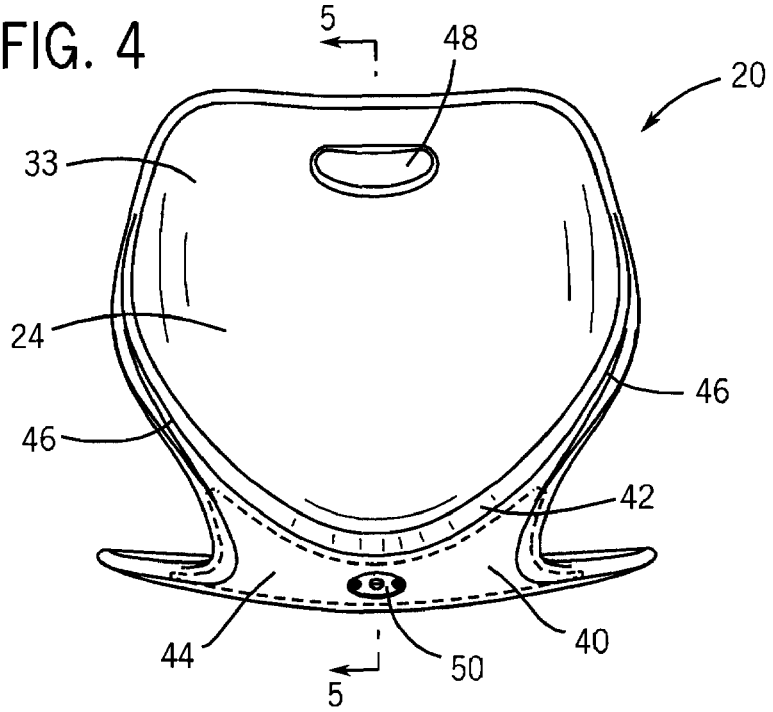

CHAIR SHELL WITH INTEGRAL HOLLOW CONTOURED SUPPORT

BACKGROUND OF THE INVENTION

The present invention relates generally to molded chairs, and more particularly, to a molded chair shell having an integral support member between the seat and the back.

Molded chair shells have been well known in the art for some time. A typical example of a molded chair shell is disclosed in U.S. Pat. No. 3,669,496, which includes a single, molded piece that forms the seat and the seat back. The chair further requires a frame, i.e., a back support, to which the molded piece is attached.

Another example of a molded chair is disclosed in U.S. Pat. No. 3,751,109, which shows a single, molded piece with legs attached at the bottom. This chair does not have a back support and therefore may be prone to material failure. Specifically, when a user sits in the chair and exerts a force on the back portion by leaning back on the back portion, the stress and strain resulting from the force will be concentrated primarily in the area that joins the seat to the back of the chair. Thus, after repeated use, this area ultimately may be prone to material failure. In such a situation, the back portion may not provide adequate support due to the degradation of the material joining the seat to the seat back, or in extreme cases, the back portion may ultimately break away from the seat portion.

There is thus a need for a molded chair shell that does not require an external frame to provide back support, which delays material failure, and has an increased life-span over prior art designs.

BRIEF DESCRIPTION OF THE INVENTION

It is an object of the present invention to provide a high strength, one-piece molded chair shell that has an increased lifespan over prior art designs. It is another object of the invention to provide a chair shell that includes a reinforcement or support which functions to distribute stress throughout the chair shell, to avoid material failure after repeated use. It is a further aspect of the invention to provide a molded chair shell with a hollow reinforcement or support, which is integral with the shell and which is formed during the molding process.

Therefore, in accordance with one aspect of the invention, a molded chair component is in the form of a shell having a seat portion having a top side and a bottom side and a back portion which extends upwardly from the seat portion. The back portion has a front side and a rear side. The chair shell includes a hollow support member between the seat portion and the back portion. The hollow support member includes a cavity that is formed by cavity walls extending along the bottom of the seat portion and the rear of the back portion.

In accordance with another aspect of the present invention, a molded chair component includes a seat portion, a back portion extending upwardly from the seat portion at a junction area, and a cavity defined by the junction area. The cavity is formed by a series of cavity walls located at the junction area, which cooperate to form a reinforcement or support for the back portion.

In accordance with a still further aspect of the present invention, a molded chair component includes a seat portion having a top side and a bottom side and a back portion joined to the seat portion at a junction. The back portion defines a front side and a rear side. The molded chair component further includes a cavity located at the junction, which is formed by a first U-shaped cavity wall that extends upwardly into the back portion, and a second U-shaped cavity wall that extends forwardly into the seat portion.

Other aspects, features, and advantages of the invention will become apparent to those skilled in the art from the following detailed description and accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

A preferred exemplary embodiment of the invention is illustrated in the accompanying drawings in which like reference numerals represent like parts throughout.

In the drawings:

FIG. 3 a bottom isometric view of the chair shell incorporated in the chair of FIG. 1;

FIG. 4 is rear elevation view of the back portion of the chair shell of FIG. 3;

DETAILED DESCRIPTION

Figure 1:
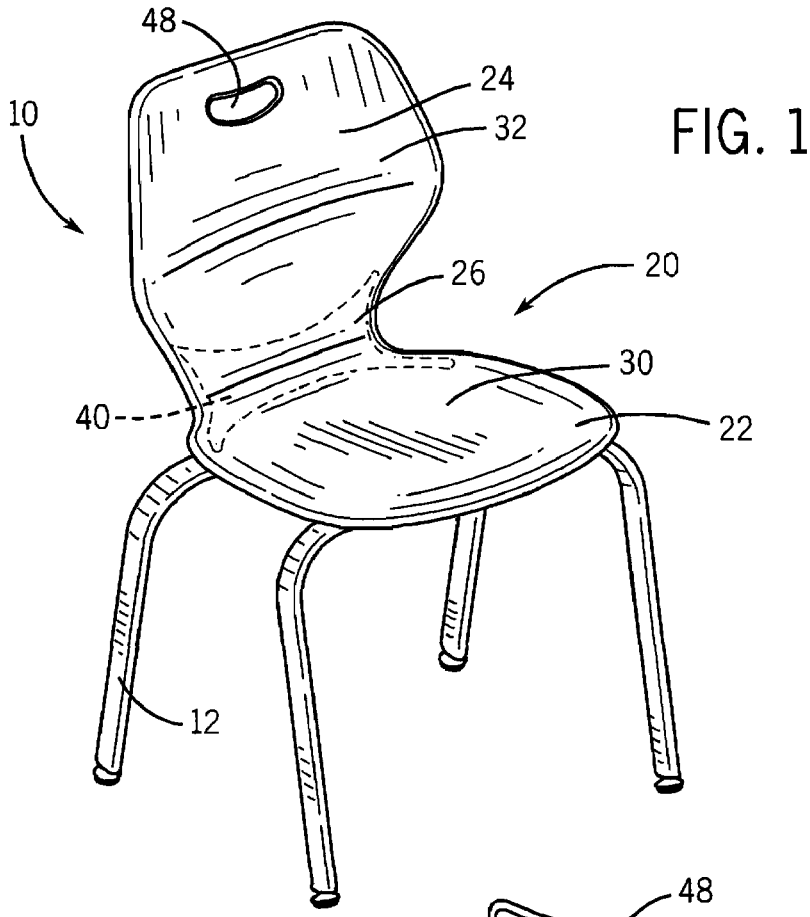
FIG. 1 is a front isometric view of a chair incorporating the chair shell in accordance with the present invention.

FIG. 1 illustrates one embodiment of a chair assembly 10 incorporating the chair shell of the present invention. The chair assembly 10 includes a chair shell 20 in accordance with the present invention, and a series of legs 12 attached to the chair shell 20. The chair assembly 10 may use any variety of leg designs known in the art, but preferably the chair assembly features four legs 12 as shown in FIG. 1. The chair shell 20 may be made using any suitable material, e.g., polypropylene, acrylic, polycarbonate, nylon, etc. but preferably it is molded plastic material.

Generally speaking, the chair shell 20 has a seat portion 22 and an adjacent pack portion 24. The seat portion 22 and the back portion 24 are connected together at a junction area 26. As is well known, the seat portion 22 provides a platform for sitting while the back portion 24 provides support for the user's back. The angle between the seat portion 22 and the back portion 24 be any satisfactory angle, and desired to accommodate user preferences.

The back portion 24 and the seat portion 22 may be any size and shape that may provide a suitable sitting surface, though in the illustrated embodiment the back portion 22 and the seat portion 24 are generally the same size. The back portion 24 and the seat portion 22 preferably taper near the junction area 26, as shown in FIGS. 1 and 3, which is the narrowest portion of the chair shell 20. In addition, the edges of the back portion 24 and the seat portion 22 are preferably rounded.

The seat portion 22 has a top side 30 and a bottom side 31. The bottom side 31 of the seat portion 22 may be configured to receive the legs 12, e.g., brackets 14 for receiving legs 12 may be attached to or integral with the bottom side 31 of the seat portion 22. See, e.g., FIG. 3. The back portion 24 similarly has a front side 32 and a rear side 33. As shown in FIG. 1, the front side 32 of the back portion 24 and the top side 30 of the seat portion 22 may combine to form a substantially continuous surface. The rear side 33 of the back portion 24 and the bottom side 31 of the seat portion 22 may similarly form a substantially continuous surface. See, e.g., FIGS. 5 and 6. Preferably, the back portion 24 and the seat portion 22 are contoured so as to provide a comfortable sitting surface. For example, the front side 33 of the back portion 22 and the top side 30 of the seat portion 22 may be slightly concave. See FIGS. 1 and 5.

The seat portion 22 and the back portion 24 are preferably solid. However, if so desired, either or both may be manufactured to be hollow, i.e., there may be space between the top side 30 and the bottom side 31 of the seat portion 22 and/or the front side 32 and the rear side 33 of the back portion 24.

Figure 5:
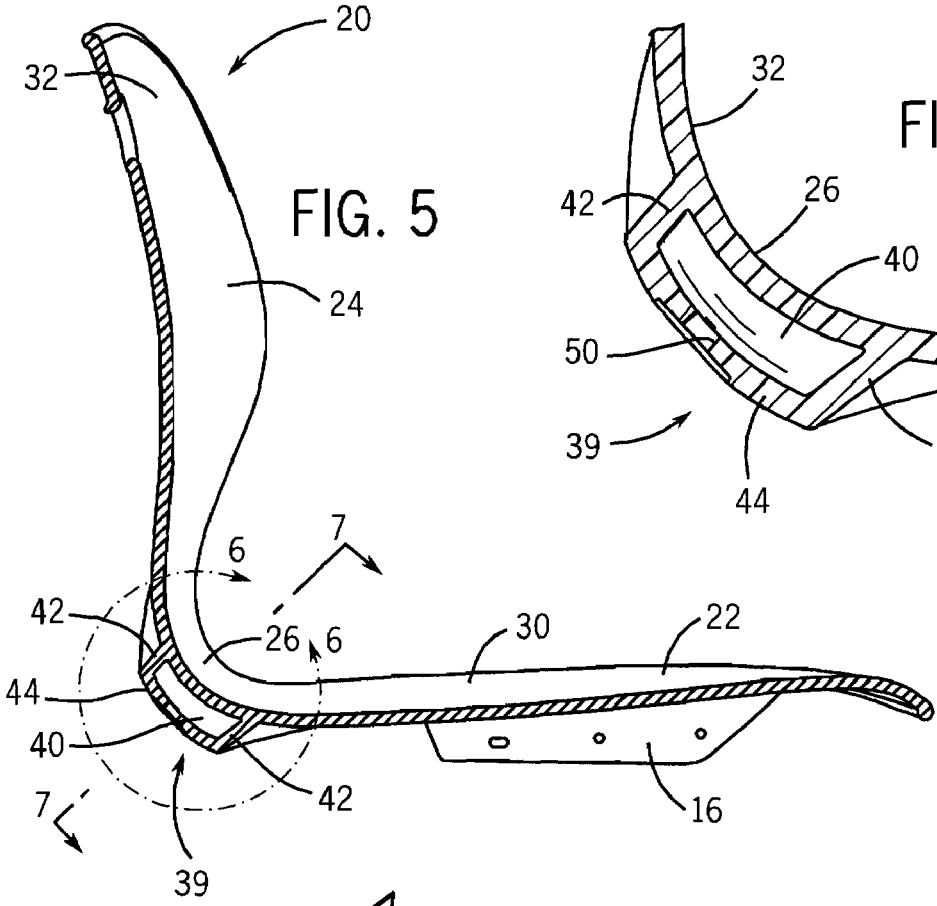
FIG. 5 is a cross-sectional view taken along line 5-5 of FIG. 4.
Figure 6:
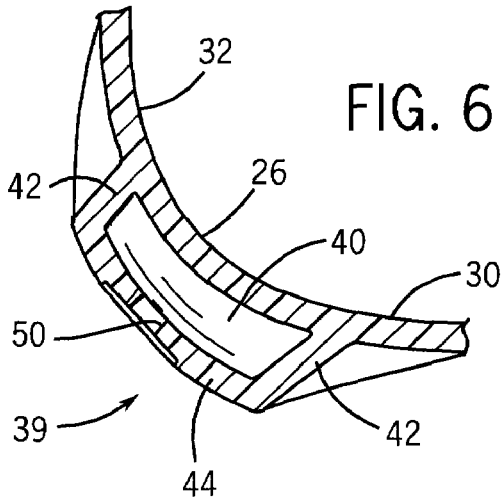
FIG. 6 is a partial cross-sectional view taken along line 6-6 of FIG. 5.
Figure 7:
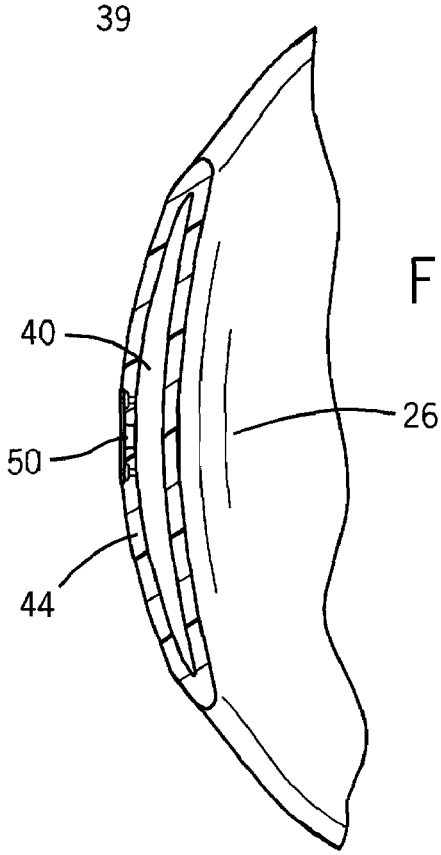
FIG. 7 is a partial cross-sectional view taken along line 7-7 of FIG. 5.

As shown in FIGS. 5-7, the chair shell 20 of the present invention further includes an integral contoured reinforcement or support 39 at the junction area 26 between the seat portion 22 and the back portion 24. The reinforcement 39 extends throughout the width of junction area 26, and includes an internal cavity 40 between the back portion 24 and the seat portion 22. More specifically, the cavity 40 is positioned on the rear side 33 of the back portion 24 and on the bottom side 31 of the seat portion 22. The shape of the cavity 40 is illustrated in dotted lines in FIGS. 1, 3 and 4.

The reinforcement or support 39 is formed by cavity side walls 42 that extend along the rear side 33 of the back portion 24 and the bottom side 31 of the seat portion 22, in combination with a cavity outer wall 44 and a pair of cavity end walls, shown at 42*c*, 42*d*. The thickness of the cavity side walls 42 may be uniform, or the thickness may gradually decrease in a direction from the base of the cavity side wall 42, i.e., the portion proximate the chair shell 20, outward.

Preferably the cavity 40 is substantially enclosed by the cavity side walls 42, end walls 42*c* and 42*d*, and the cavity outer wall 44, but there may be openings in the cavity walls as desired. Additionally, the cavity 40 may be divided into a plurality of chambers or sections (not shown) by internal cavity walls, if desired.

As can be seen in FIG. 3, the cavity 40 preferably is positioned over the junction area 26 where the seat portion 22 and the back portion 24 are joined. More specifically, a first cavity wall 42*a* is located on the seat portion 22 and a second cavity wall 42*b* is located on the back portion 24 opposite the first cavity wall 42*a*. As noted above, cavity end walls 42*c* and 42*d* are located on both the back portion 24 and the seat portion 22, thus spanning the junction area 26 and extending between and joining cavity walls 42*a*, 42*b*. The outer wall 44 functions to closes the cavity 40, and is adjacent and supported by the various cavity walls 42. The cavity outer wall 44 is preferably convex, e.g., it may have generally the same curvature as the chair shell 20 in the junction area 26. Preferably, the cavity walls 42 and cavity outer wall 44 are integral with the chair shell 20 and formed during the molding process. Representatively, the shell 20 is formed in an injection molding process, and the cavity 40 is formed using a gas injection process that is carried out during the injection molding of shell 20. The cavity 40 preferably encompasses all or a substantial portion of the junction area 26.

Positioning the cavity 40 over the junction area 26 provides reinforcement and support to the junction area 26, which allows the use of a relatively thin material for the back portion 24 and the seat portion 22 of the chair shell 20. More specifically, the stress resulting from a force on the back portion 24 will be distributed throughout the cavity walls 42, 44 of the reinforcement or support 39. Accordingly, the junction area 26 is subjected to lower stress levels due to the presence of the hollow reinforcement or support 39

Figure 2:
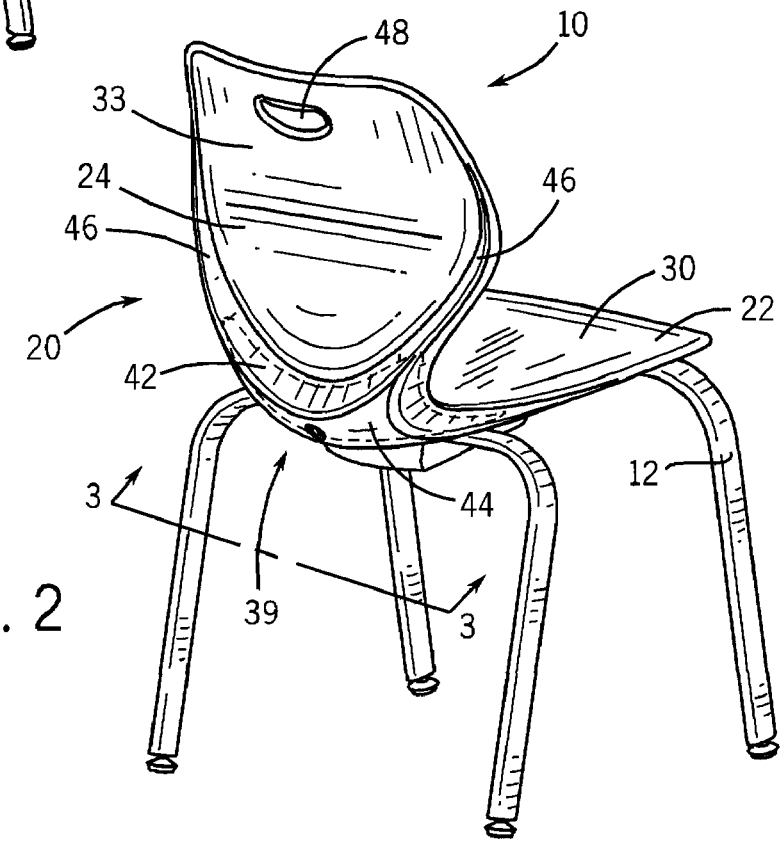
FIG. 2 is a rear isometric view of the chair of FIG. 1.

As shown in FIGS. 2 and 3, the reinforcement or support 39 preferably forms outer ribs 46 that extend upwardly along the edges of the rear side 33 of the back portion 24, and forwardly along the edges of the bottom side 31 of the seat portion 22. For example, the second cavity wall 42*b* and the cavity end wall 42*c* join together to form a rib 46. The first cavity wall 42*a* and cavity end wall 42*d*, the first cavity wall 42*a* and the cavity end wall 42*c*, and the second cavity wall 42*b* and the cavity end wall 42*d* similarly form ribs 46. The cavity 40 may extend through the ribs 46 or partially through the ribs 46 as shown in dashed lines in FIGS. 1-4, or the ribs 46 may be closed off, i.e., solid. In such a configuration, i.e., when a rib 46 is solid, the width of the rib 46 may be substantially uniform throughout the rib 46, or the width of the rib 46 may taper to the distal end of the rib.

The ribs 46 are positioned along the respective edges of the back portion 24 and the seat portion 22, and terminate below the top of the back portion 24 and rearwardly of the front of the seat portion 22. The ribs 46 function to further dissipate stress that would otherwise be concentrated on the junction area 26. The ribs 46 generally recede or taper into the respective surface, e.g., either the rear side 34 or the bottom side 32, i.e., the height of the rib 46 gradually decreases. See FIG. 2.

Using such a configuration for the ribs 46, the reinforcement or support 39 and the ribs 46 provide further support while still maintaining flexibility in the chair shell 20, e.g., the degree of flexibility in the back portion 24 may increase as the height and/or width of the ribs 46 decreases. Additionally, the flexibility of the back portion 24 with respect to the seat portion 22 depends on a variety of factors including, but not limited to, the material properties of the plastic used to form the chair shell 20, the height and width of the back portion 24, the thickness of the back portion 24 and the height and thickness of the cavity walls 42. These dimensions may all be adjusted in order to provide the desired degree of flexibility in the chair shell 20. As can be seen in FIGS. 6 and 7, the seat portion 22, cavity walls 42, cavity outer wall 44 and back portion 24 preferably have substantially the same thickness.

Thus, by using the preferred configuration for the ribs 46, i.e., positioning ribs 46 along the edges of the back portion 24 and the seat portion 22, it is possible to reduce or eliminate material failure of the chair shell 20 in the junction area 26 while providing a comfortable sitting experience to the user. More specifically, the material properties of the molded chair shell 20 may allow for the back portion 24 to move or flex with respect to the seat portion 22 when a force is exerted on the back portion 24 by a user leaning back in the chair. This flexibility in the back portion 24 may provide a more comfortable sitting experience for the user. Different degrees of flexibility may be achieved by using different materials and/or material thicknesses to form the chair shell 20.

As shown in FIGS. 2 and 3, the cavity 40 is preferably generally symmetrical about its center, in order to distribute stress evenly rather than concentrating stress at a certain point. As shown in FIGS. 3 and 4, the cavity walls 42 are preferably U-shaped with the walls 42 forming ribs 46 extending along the respective edges of the back portion 24 and the seat portion 22.

Additionally, the back portion 24 may feature an aperture that can serve as a handle 48, which may be useful for stacking, un-stacking or positioning like chair assemblies 10.

The chair shell 20 of the present invention is preferably formed of durable, lightweight plastic. This may allow for easy transportation and storage of the chair shell s 20 or chair assemblies 10. Preferably, the chair shell 20 is contoured so as to be easily stackable with another like chair shell 20, which may further allow for easy transportation and storage. The chair shell 20 of the present invention is a modular unit that may be able to be manufactured relatively inexpensively and mass produced efficiently. Further, the chair shell 20 may be manufactured to have any color as desired.

As will be appreciated by those skilled in the art, a product, e.g., a chair shell 20, formed by molding using a gas injection process will typically have a gate, shown at 50, which functions to enclose an opening through which gas is injected during manufacture. Though the location of the gate 50 may vary, the gate 50 may be located at the center of the cavity end wall 44, to provide the symmetrical shape of cavity 40 as shown and described.

Various alternatives and modifications are contemplated as being within the scope of the following claims particularly pointing out and distinctly claiming the subject matter regarded as the invention.

We claim:

1. A molded chair shell comprising:

a seat portion having laterally spaced side edges and a front area and a rear area, wherein at least the rear area of the seat portion defines an upwardly facing surface;

a back portion having laterally spaced side edges and an upper area and a lower area, wherein at least the lower area of the back portion defines a forwardly facing surface;

a junction area between the rear area of the seat portion and the lower area of the back portion, wherein the junction area extends across a width of the chair shell between the side edges of the seat and back portions and defines a wall that is formed integrally with and extends between the upwardly facing surface of the seat portion and the forwardly facing surface of the back portion; and a reinforcement member between the seat portion and the back portion, wherein the reinforcement member comprises a pair of cavity side walls and an outer wall, wherein a first one of the cavity side walls extends outwardly from the rear area of the seat portion and a second one of the cavity side walls extends outwardly from the lower area of the back portion, and wherein the outer wall of the reinforcement member is spaced outwardly of the wall of the junction area, wherein the outer wall of the reinforcement member extends between and interconnects the cavity side walls, and wherein the wall of the junction area extends between and interconnects the cavity side walls, wherein the cavity side walls and the outer wall of the reinforcement member, in combination with the wall of the junction area, cooperate to define a hollow internal cavity that is located at the junction area;

wherein the rear area of the seat portion, the lower area of the back portion, and the reinforcement member are formed integrally with each other, wherein the integral formation of the outer wall of the reinforcement member and the wall of the junction area cooperate to define an integrally formed double wall construction at the junction area, and wherein the rear area of the seat portion and the lower area of the back portion are configured to define a single wall construction forwardly and above the junction area, respectively, wherein the double wall construction at the junction area and the single wall construction forwardly and above the junction area, respectively, are formed integrally with each other.

2. The molded chair shell according to claim 1, wherein the cavity walls form ribs that are located on the back portion and on the seat portion.

3. The molded chair shell according to claim 2, wherein the ribs comprise a pair of ribs positioned along opposing edges of the back portion, and a pair of ribs positioned along opposing edges of the seat portion.

4. The molded chair shell according to claim 3, wherein each rib defines a distal end, and wherein each rib defines a tapered cross section in a direction from the junction area toward the distal end.

5. The molded chair shell according to claim 1, wherein the cavity walls are U-shaped.

6. The molded chair shell according to claim 5, wherein the shell defines a width at the junction area that is narrower than a width defined by the seat portion and the back portion, wherein the cavity walls extend from the junction area forwardly into the seat portion and upwardly into the back portion.

7. The molded chair shell according to claim 1, wherein the cavity walls form ribs that extend along opposing side edges defined by the seat portion and along opposing side edges defined by the back portion, and wherein the internal cavity extends outwardly from the junction area at least partially into each of the ribs.

8. The molded chair shell according to claim 1, further comprising leg structure attached to the seat portion to form a chair assembly.

9. The chair shell according to claim 8, wherein the chair assembly is stackable with a like chair assembly.

10. A molded chair shell comprising:

a seat portion defining laterally spaced side edges and a rear area;

a back portion defining laterally spaced side edges and a lower area that is joined to the rear area of the seat portion at a junction area, wherein the junction area extends across a width of the chair shell between the side edges of the seat and back portions and defines a front wall that extends between the rear area of the seat portion and the lower area of the back portion; and a reinforcement area including an internal cavity substantially positioned at the junction area, wherein the reinforcement area is formed by the front wall of the junction area in combination with a series of cavity walls including an outer cavity wall that is spaced rearwardly from the front wall of the junction area, and wherein the reinforcement area further includes at least a pair of ribs that extend from the junction area into at least one of the rear area of the seat portion and the lower area of the back portion, wherein the ribs are spaced apart from each other, and wherein the reinforcement area is configured such that the internal cavity extends at least partially into each of the ribs;

wherein the rear area of the seat portion, the lower area of the back portion and the reinforcement area including the ribs and the outer cavity wall are formed integrally with each other.

11. The molded chair shell according to claim 10, wherein the cavity is substantially symmetrical about a center area.

12. The molded chair shell according to claim 10, wherein the reinforcement area includes ribs that extend from the junction area into both the seat portion and the back portion, wherein the ribs are configured to extend along side edges defined by the seat portion and along side edges defined by the back portion.

13. The molded chair shell according to claim 12, wherein each rib defines a tapered cross section in a direction outwardly from the reinforcement area.

14. The molded chair shell according to claim 10, wherein the series of cavity walls includes the outer cavity wall and a pair of cavity side walls that extend between the outer cavity wall and the front wall of the junction area, wherein the reinforcement area includes ribs that extend from the junction area into both the seat portion and the back portion, wherein the ribs are defined at least in part by the cavity side walls and are configured to extend along side edges defined by the seat portion and along side edges defined by the back portion, and wherein the cavity side walls are U-shaped.

15. The molded chair shell according to claim 10, wherein the series of cavity walls defined by the reinforcement area includes a pair of cavity side walls that extend outwardly from the junction area in combination with the outer cavity wall that is spaced rearwardly from the front wall of the junction area, wherein the outer cavity wall extends between and interconnects the pair of cavity side walls.

16. The molded chair shell according to claim 15, wherein each pair of ribs defines a tapered cross section in a direction extending outwardly from the junction area.

17. A molded chair shell comprising:

a seat portion having a rear area defining a top surface and a bottom surface;

a back portion joined to the seat portion at a junction area, the back portion having a lower area defining a front surface and a rear surface;

wherein the junction area includes a front wall that extends between and interconnects the top surface of the rear area of the seat portion and the front surface of the lower area of the back portion; and a reinforcement area positioned at and formed integrally with the junction area, wherein the reinforcement area includes an internal cavity formed by the front wall of the junction area in combination with an outer wall and a pair of side walls extending therebetween, wherein at least one of the side walls comprises a U-shaped wall, wherein a central area of the U-shaped wall at least in part defines the internal cavity and wherein a pair of spaced apart side portions of the U-shaped wall define a pair of ribs, wherein each rib extends along one of a pair of spaced apart side edges defined by at least one of the back portion and the seat portion;

wherein the rear area of the seat portion, the lower area of the back portion and the reinforcement area including the ribs and the outer wall are formed integrally with each other.

18. The molded chair shell according to claim 17, wherein the internal cavity extends outwardly from the junction area at least partially into each of the ribs.

19. The molded chair shell according to claim 18, wherein each of the cavity side walls comprises a U-shaped wall, one of which is configured to define ribs that extend along opposing side edges defined by the seat portion and one of which is configured to define ribs that extend along opposing side edges defined by the back portion.

* * * * *